US006666807B2

(12) United States Patent
Codet et al.

(10) Patent No.: US 6,666,807 B2
(45) Date of Patent: Dec. 23, 2003

(54) COATING ROD FOR PAPER MANUFACTURING MACHINES

(75) Inventors: Christian Codet, Giromagny (FR); Bernard Hansz, Nommay (FR)

(73) Assignee: BTG Eclepens S.A., Eclepens (CH)

( * ) Notice: Subject to any disclaimer, the term of this patent is extended or adjusted under 35 U.S.C. 154(b) by 0 days.

(21) Appl. No.: 09/560,651

(22) Filed: Apr. 26, 2000

(65) Prior Publication Data

US 2003/0092549 A1 May 15, 2003

Related U.S. Application Data

(63) Continuation-in-part of application No. PCT/FR98/02299, filed on Oct. 27, 1998.

(30) Foreign Application Priority Data

Oct. 27, 1997 (FR) ..... 97 13450

(51) Int. Cl.[7] ..... F16C 13/00

(52) U.S. Cl. ..... 492/59; 492/53; 29/895.32

(58) Field of Search ..... 492/54, 53, 58, 492/59, 57, 49, 37; 162/118, 287; 427/367; 29/895.32

(56) References Cited

U.S. PATENT DOCUMENTS 4,621,936 A * 11/1986 Hansson et al. ..... 401/215
4,626,516 A * 12/1986 Morelock ..... 501/92
4,704,776 A * 11/1987 Watanabe et al. ..... 492/54
4,856,161 A * 8/1989 Miihkinen ..... 492/54
4,912,835 A * 4/1990 Harada et al. ..... 492/3
4,967,663 A * 11/1990 Metcalf ..... 101/348
4,991,501 A * 2/1991 Yokoyama et al. ..... 29/895.32
5,056,220 A * 10/1991 Telama ..... 29/895.32
5,111,567 A * 5/1992 Leino et al. ..... 29/895.32
5,111,568 A * 5/1992 Telama ..... 29/895.32
5,223,099 A * 6/1993 Salo ..... 162/207
5,647,279 A * 7/1997 Johner et al. ..... 492/54
5,667,641 A * 9/1997 Poirier et al. ..... 492/53
5,967,959 A * 10/1999 Niemi et al. ..... 492/54
5,980,765 A * 11/1999 Machida et al. ..... 216/52
6,057,047 A * 5/2000 Maloney ..... 428/623
6,200,248 B1 * 3/2001 Vestola et al. ..... 492/54
6,339,883 B1 * 1/2002 Graf et al. ..... 29/895.32
6,341,420 B1 * 1/2002 Swartz et al. ..... 29/895.32
6,398,702 B1 * 6/2002 Schlafer et al. ..... 492/58

FOREIGN PATENT DOCUMENTS

EP 0 870 867 A2 * 10/1998
JP 403042290 * 2/1991

* cited by examiner

*Primary Examiner*—Gregory Vicovich
*Assistant Examiner*—Marc Jimenez
(74) *Attorney, Agent, or Firm*—Clifford W. Browning; Woodard, Emhardt, Moriarty, McNett & Henry LLP

(57) ABSTRACT

The invention concerns a coating bar for pulp and paper manufacture, comprising a substrate coated over at least the greater part of its surface with a coat comprising a ceramic, characterised in that the coat consists of a mixture of ceramics, the coat having a wettability angle between 30° and 90°, and porosity less than 5%, the size of the pores being less than 5 $\mu$m.

14 Claims, 3 Drawing Sheets

COATING ROD FOR PAPER MANUFACTURING MACHINES

Figure 1:
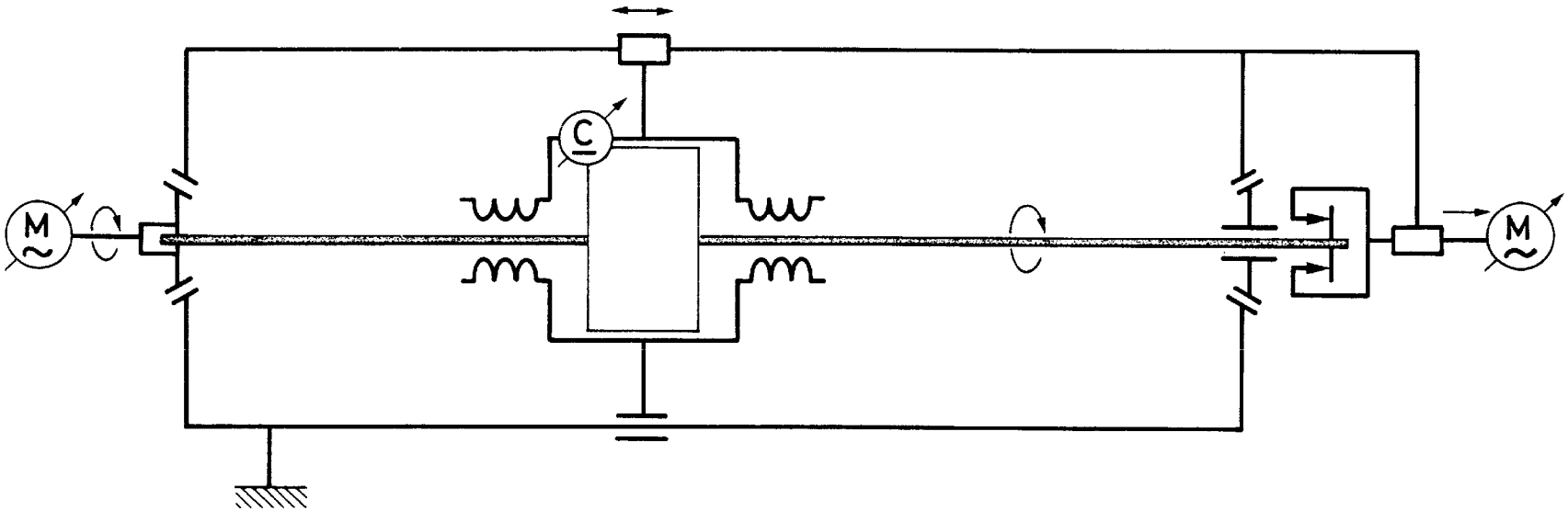

This Application is a Continuation-in-Part of PCT/FR98/02299, filed on Oct. 27, 1998.

BACKGROUND OF THE INVENTION

1) Field of the Invention

The present invention relates to a coating rod for paper or cardboard manufacturing machines.

2) Description of the Prior Art

Coating rods are used in the paper industry for conveying a coating material (or "sauce") on to cardboard or paper in order to produce a coated cardboard or coated paper. The coating rod is constituted by a metal bar having a diameter generally between 9 and 20 mm and a length generally between 2 m and 10 m. The coating rod is generally held in some sort of support, such as a polymer sleeve, which is also referred to as a bed, in which it can turn. The coating rod, when turning, constitutes also a scraper which removes the excess coating material or "sauce" from the paper, the measuring out of the deposited coating material or the obtaining of a desired thickness of material on the paper being obtained by varying the pressure of application of the coating rod on the paper and/or by varying the speed of rotation.

The industrial limits of such a method led to designing another type of coating rods which make it possible to increase the amount of coating material deposited on the paper. The improvement consisted in winding a metal wire around the coating rod. By using metal wires of different diameters, the free volume between two consecutive turns of wire can be varied, which makes it possible to obtain a larger or smaller reservoir measuring out coating material. Subsequently, it has been preferred to engrave grooves or flutes in the coating rod, thereby obtaining a profiled coating rod, said flutes or grooves having the same function as the wound metal wires.

Coated paper is a paper with high added value and in general of very high quality, the paper being obtained by depositing two or three coats of coating material on each side. To that end, the machines comprise four, and even more, coating heads. With the speed of paper production continually increasing, transfer rollers are being used more and more in the paper manufacturing machines, the coating rod still being used for depositing a given amount of coating material on the paper. On these machines, the coating rod is used for a "pre-coating on size press". It follows that an intensive use of the coating rods in the manufacturing machines leads to rapid wear of said rods, said wear being accelerated when a pigmented coating material is used because of the high abrasion of the pigments on the coating rods. The consequence of this rapid wear is that it is necessary to change the coating rods of each machine every second day. As at present the machines each comprise eight coating rods, the impact of coating rods on paper manufacture costs can be assessed without difficulty.

In order to attempt to reduce the wear of the coating rods, a chrome surfacing layer has been produced on said coating rods. But the coating rods produced in this way do not give complete satisfaction even though appreciable advances have been made.

SUMMARY OF THE INVENTION

The aim of the present invention is to propose a smooth or profiled coating rod whose lifetime has been considerably increased, preferably by at least 50%.

One object of the present invention is a coating rod which is coated with a surfacing layer constituted by at least one ceramic, said surfacing layer having an angle of wetting or wettability between 30° and 90° and a porosity less than 5%, the pore size not exceeding 5 $\mu$m.

Because of the different surface tensions which exist between the coating rod and the coating material on one hand, and the transfer roller with which the rod cooperates and the coating material on the other hand, the behaviour of the coating material can vary from one situation to another. It has been found that it is necessary for the surface tension between the transfer roller and the coating material to be greater than the surface tension existing between said coating material and the coating rod, if it is wished that all or almost all of the coating material contained, for example, in the hollows of the flutes be transferred. If the wettability of the surfacing layer of the coating rod is not sufficient, then dry friction occurs between the surfacing layer and the coating material. But, if the wettability of the surfacing layer of the coating rod is too great, then at least some of the coating material remains on the surfacing layer, for example in the bottom of the flutes. In the latter case, the flutes do not fully perform their measuring out function since a certain amount of coating material remains trapped in the bottom of the flutes.

Therefore, according to one feature of the present invention, the angle of wetting or wettability of the surfacing layer is between 30° and 90° and, preferably, between 60° and 85°.

Therefore, according to another feature of the invention, the porosity of the surfacing layer is less than 5% and the pore size does not exceed 5 $\mu$m, for avoiding excessively high coating material retentivity.

BRIEF DESCRIPTION OF THE DRAWING FIGS

Figure 2:
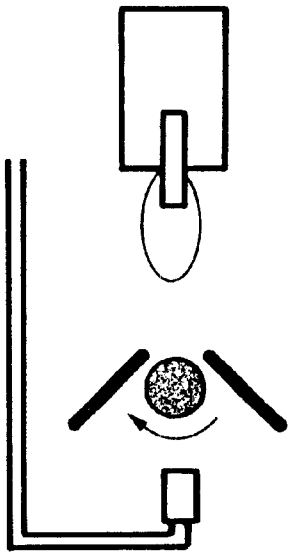
Figure 3:
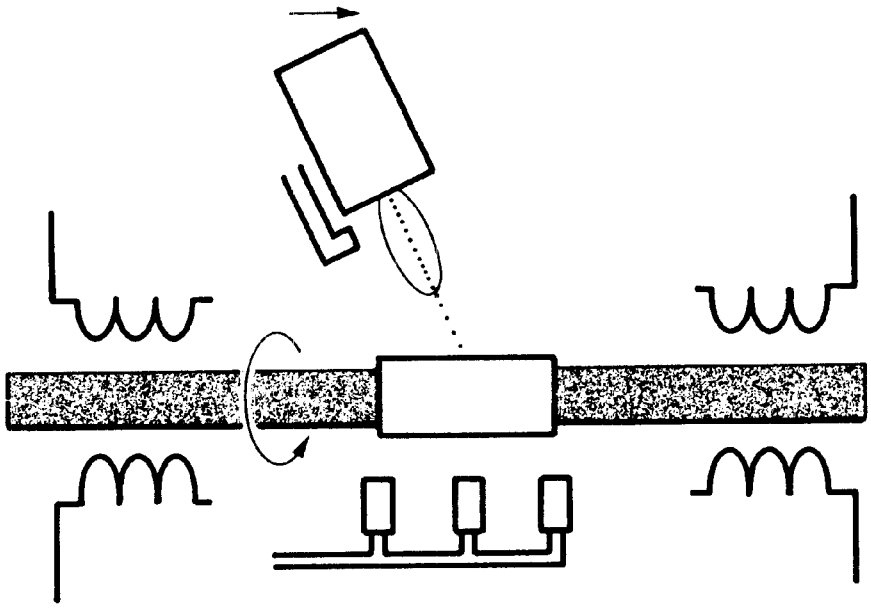
Figure 4:
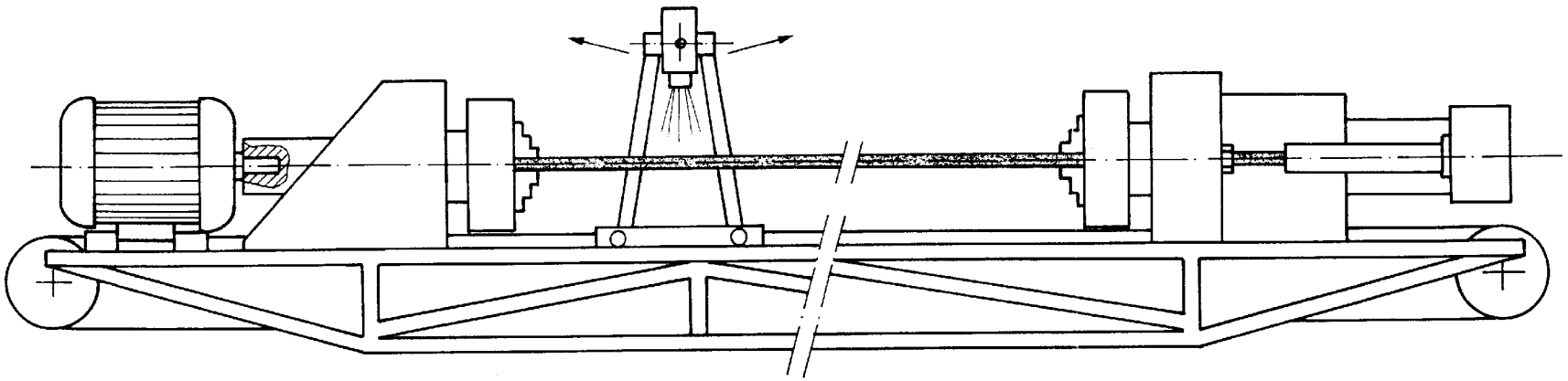

FIG. 1 is a schematic representation of one embodiment of a device for producing a coating rod 1 for use in the paper industry, FIG. 2 is a schematic representation of a side view of the device of FIG. 1, FIG. 3 is a schematic representation of a face view of the device of FIG. 1, FIG. 4 is a schematic representation of certain mechanical parts of the device of FIG. 1.

DESCRIPTION OF THE PREFERRED EMBODIMENTS

The surfacing layer may be obtained by spraying, on to the coating rod, a powder of finely divided ceramic material. The wettability of the surfacing layer of the coating rod is modified by varying certain parameters of said surfacing layer, such as the porosity or pore size, the structure of the surfacing layer, for example within the lattice of a ceramic or a ceramic mixture used to constitute said surfacing layer. The wettability of the surfacing layer may also be modified, in particular may be diminished, by a finishing treatment step.

The surfacing layer possibly being constituted by juxtaposed ceramic grains, operating parameters of the spraying device as well as granulometry of the sprayed powder may be adjusted. It will be preferable, in certain cases, to vary the concentration by weight or molar content of the (constituents of the ceramics used in a ceramic mixture.

The granulometry of the powder used for the spraying process should preferably be less than 80 $\mu$m, and more preferably between 10 and 45 μm. The powder grains may consist of agglomerated ceramic particles, or of agglomerated and sintered ceramic particles, with a particle size of less than 5 μm and, preferably, of the order of 1 μm. The powder may also consist of fused and crushed ceramic material. A surfacing layer with a thickness of between 15 and 60 μm is thus obtainable, after thermal spraying.

The preferred ceramics according to the invention are chosen from amongst $Cr_2O_3$, MgO, $Al_2O_3$, $TiO_2$, $SiO_2$ and $ZrO_2$ and mixtures thereof.

A mixture comprising ceramics $ZrO_2$, $Al_2O_3$, $SiO_2$ and $TiO_2$ can be used.

It is preferred to use a mixture of ceramics comprising a main constituent by weight, whose content is at least 40% by weight with respect to the mixture, and Preferably at least 60% by weight with respect to the mixture.

One particular mixture is constituted by 50% $Cr_2O_3$ in moles and 50% MgO in moles.

Another particular mixture of ceramics has, in moles, the following composition:

48% $Al_2O_3$,

35% $TiO_2$,

15% $Cr_2O_3$,

2% $SiO_2$.

A third particular mixture of ceramics has in moles, the following composition:

72% $Cr_2O_3$, 23,5% $Al_2O_3$, 4,5% $TiO_2$,

Carbides and nitrides can also be used.

EXAMPLE

The spraying device is a device as described in Applicant's copending Application PCT/FR 98/02300, herein incorporated by reference. The above mentioned third particular mixture is used.

The conditions for spraying the chosen mixture of ceramics are as follows:

SULZER-METCO $F_4$ type torch,

Power distributed to the torch: 30 kW,

Current: 600A,

Argon: 42 l/min,

Hydrogen: 12 l/min,

Distance between torch and rod: 110 mm,

Powder feed rate of powder mixture: 32 g/min,

Rotation speed of the rod: 500 rpm,

Translation speed of the torch: 50 mm/sec.

During spraying, the coating rod is kept at a temperature below 50° C. by means of a jet of $CO_2$ for example.

The surfacing layer obtained according to the spraying process has a certain surface roughness which it is necessary to eliminate for the most part in order not to impair the surface of the completed coating rod. A finishing treatment is applied to the surfaced coating rod so as to obtain a surface roughness Ra less than 0.5 μm. The surface roughness, usually termed Ra, is defined as the arithmetical average distance of a surface point with respect to the mean surface level.

The finishing surface treatment can for example be wet polishing. Another treatment consists in placing the coating rod in a rubber cylinder or between two rubber cylinders which turn on the coating rod, the coating rod/rubber cylinder assembly being dipped in a slurry with 50% by volume of $CaCO_3$, $TiO_2$ or some other abrasive grains.

The finished coating rod exhibits a wettability between 70°–75°, a mean pore size of about 4 μm and a porosity of about 4%.

Numerous variations in the materials, devices and methods of this invention, within the scope of the appended claims, will occur to those skilled in the art in light of the foregoing disclosure.

Having thus described the invention, what is claimed and desired to be secured by Letters Patent is:

1. A coating rod for a coated paper or coated cardboard manufacturing machine, said coating rod consisting of a surfaced metal bar sized to be received and held in a coating rod holding bed of a coated paper or coated cardboard manufacturing machine, said metal bar being covered over a major portion of its length with a thermally sprayed ceramic surface layer said surface layer having an angle of wettability between 30° and 90°, a pore size less than 5 μm, and a porosity less than 5%.

2. A coating rod according to claim 1, wherein said angle of wettability is between 60° and 85°.

3. A coating rod according to claim 1, wherein said ceramic surface layer has a surface roughness Ra less than 0.5 μm.

4. A coating rod according to claim 1, wherein said ceramic surface layer consists of a mixture of ceramics comprising a main constituent whose content is at least 40% by weight with respect to the total content of the mixture.

5. A coating rod according to claim 4, wherein said ceramics e selected from the group consisting of Cr2O3, MgO, Al2O3, TiO2, SiO2, ZrO2 and mixtures thereof.

6. A coating rod according to claim 4, wherein said mixture is made of $ZrO_2$, $Al_2O_3$, $SiO_2$ and $TiO_2$.

7. A coating rod according to claim 4, wherein said mixture is made of 50% by moles of $Cr_2O_3$ and MgO.

8. A coating rod according to claim 4, wherein said mixture has a molar content of 48% $Al_2O_3$, 35% $TiO_2$, 15% $Cr_2O_3$, 2% $SiO_2$.

9. A coating rod according to claim 4, wherein said mixture has a molar content of 72% $Cr_2O_3$, 23,5% $Al_2O_3$ 4,5% $TiO_2$%.

10. A coating rod according to claim 1, wherein said ceramic surface layer consists of a mixture of ceramics comprising a main constituent whose content is at least 60% by weight with respect to the total content of the mixture.

11. A coating rod according to claim 1, wherein said ceramic surfacing ceramic surface layer has a thickness of between 15 μm and 60 μm.

12. A coating rod according to claim 1, wherein said surface layer is obtained by spraying a ceramic material that is in form of a powder with a granulometry of less than 80 μm onto said metal bar.

13. A coating rod according to claim 12, wherein said ceramic material is in form of a powder having a granulometry of between 10 μm and 45 μm.

14. A coating rod according to claim 13, wherein grains of said powder are selected from the group consisting of fused and crushed ceramic material, agglomerated ceramic particles and agglomerated and sintered ceramic particles, wherein the size of said particles is less than 5 μm.

* * * * *

UNITED STATES PATENT AND TRADEMARK OFFICE

CERTIFICATE OF CORRECTION

PATENT NO. : 6,666,807 B2 
DATED : December 23, 2003
INVENTOR(S) : Christian Coddet and Bernard Hansz It is certified that error appears in the above-identified patent and that said Letters Patent is hereby corrected as shown below:

Title page,
Item [75], Inventors, please delete "Codet" and insert in lieu thereof -- Coddet --.

Column 2,
Line 65, please delete "(constituents" and insert in lieu thereof -- constituents --.

Column 3,
Line 15, please delete "Preferably" and insert in lieu thereof -- preferably --.
Line 27, please delete "has in moles," and insert in lieu thereof -- has, in moles, --.

Column 4,
Line 29, please delete "ceramics e selected" and insert in lieu thereof -- ceramics are selected --.
Lines 29 and 30, please delete "Cr203, MgO, Al203, TiO2, SiO2, ZrO2" and insert in lieu thereof -- $Cr_2O_3$, MgO, $Al_2O_3$, $TiO_2$, $SiO_2$, $ZrO_2$ --.
Lines 54 and 55, please delete "wherein said surface layer" and insert in lieu thereof -- wherein said ceramic surface layer --.

Signed and Sealed this

Twenty-fifth Day of May, 2004

JON W. DUDAS
*Acting Director of the United States Patent and Trademark Office*